US008143509B1

(12) United States Patent
Robertson et al.

(10) Patent No.: US 8,143,509 B1
(45) Date of Patent: Mar. 27, 2012

(54) SYSTEM AND METHOD FOR GUITAR SIGNAL PROCESSING

(75) Inventors: Jamie Robertson, Waltham, MA (US); Jeremy Todd, Cambridge, MA (US); Alexey Lukin, Moscow (RU)

(73) Assignee: iZotope, Inc., Cambridge, MA (US)

( * ) Notice: Subject to any disclaimer, the term of this patent is extended or adjusted under 35 U.S.C. 154(b) by 478 days.

(21) Appl. No.: 12/354,918

(22) Filed: Jan. 16, 2009

Related U.S. Application Data

(60) Provisional application No. 61/021,494, filed on Jan. 16, 2008.

(51) Int. Cl.
*G10H 1/00* (2006.01)

(52) U.S. Cl. ..... 84/604; 84/605; 84/607

(58) Field of Classification Search ..... 84/602–605, 84/607, 625

See application file for complete search history.

(56) References Cited

U.S. PATENT DOCUMENTS

| | | | | | |
|---|---|---|---|---|---|
| 2,897,709 | A * | 8/1959 | McCarty et al. | ..... | 84/726 |
| 2,964,985 | A * | 12/1960 | Webster | ..... | 84/723 |
| 3,499,357 | A * | 3/1970 | Peterson, Jr. | ..... | 84/285 |
| 3,530,756 | A * | 9/1970 | Chapman | ..... | 84/726 |
| 3,571,483 | A | 3/1971 | Davidson | | |
| 3,673,304 | A * | 6/1972 | Dudas | ..... | 84/722 |
| 4,377,101 | A * | 3/1983 | Santucci | ..... | 84/743 |
| 4,378,722 | A | 4/1983 | Isakson | | |
| 4,483,233 | A * | 11/1984 | Benson | ..... | 84/263 |
| 4,854,210 | A | 8/1989 | Palazzolo | | |
| 4,922,797 | A * | 5/1990 | Chapman | ..... | 84/650 |
| 5,136,918 | A | 8/1992 | Riboloff | | |
| 5,311,806 | A | 5/1994 | Riboloff | | |
| 5,834,671 | A | 11/1998 | Phoenix | | |
| 5,898,121 | A | 4/1999 | Riboloff | | |
| 6,043,422 | A * | 3/2000 | Chapman | ..... | 84/723 |
| 6,112,266 | A * | 8/2000 | Yeh | ..... | 710/52 |
| 6,121,537 | A | 9/2000 | Pawar et al. | | |
| 6,346,661 | B1 * | 2/2002 | Yaskoweak | ..... | 84/267 |
| 6,649,818 | B2 * | 11/2003 | Bailey | ..... | 84/293 |
| 6,660,918 | B1 * | 12/2003 | Yaskoweak | ..... | 84/267 |
| 6,781,050 | B2 | 8/2004 | Olvera et al. | | |
| 6,822,156 | B1 | 11/2004 | Lazarus et al. | | |
| 6,995,311 | B2 * | 2/2006 | Stevenson | ..... | 84/737 |
| 7,385,125 | B2 * | 6/2008 | Motsenbocker | ..... | 84/292 |
| 7,514,626 | B1 * | 4/2009 | Snyder | ..... | 84/733 |
| 2003/0164080 | A1 * | 9/2003 | Childress | ..... | 84/291 |
| 2004/0025676 | A1 * | 2/2004 | Shadd | ..... | 84/743 |
| 2004/0187673 | A1 * | 9/2004 | Stevenson | ..... | 84/737 |
| 2006/0213358 | A1 * | 9/2006 | Motsenbocker | ..... | 84/731 |
| 2008/0134859 | A1 * | 6/2008 | Shelton | ..... | 84/267 |

* cited by examiner

*Primary Examiner* — David S. Warren
(74) *Attorney, Agent, or Firm* — David Lowry

(57) ABSTRACT

A pickup processing system for a guitar or other musical instrument. According to one embodiment, a split pickup is employed that separates the sound from the two bass strings from the other four strings. The signal from the bass strings may be provided to an octave divider, which creates a bass sound to add back into the sound. The octave divider produces sound without discontinuities or other artifacts. Other effects include restored acoustical properties of the guitar body, stereo imaging, reverb and others. The present invention may be fully contained within the body of an acoustic guitar.

18 Claims, 6 Drawing Sheets

SYSTEM AND METHOD FOR GUITAR SIGNAL PROCESSING

This application claims priority to provisional U.S. Application Ser. No. 61/021,494 filed on Jan. 16, 2008, which is incorporated herein by reference.

FIELD OF THE INVENTION

The invention relates generally to signal processing. More specifically, the invention provides a system and method for processing sound for a guitar or similar instrument.

BACKGROUND OF THE INVENTION

Many types of pickups are available for guitars, ranging from coil pickups for metal strings, microphones, and piezo element pickups. Acoustic guitars typically employ a single piezo element installed under the saddle (UST—under saddle transducer). The monophonic signal from this piezo transducer, comprising the summed signals of all 6 strings, is usually run to an on-board (in the guitar) single-channel analog preamp that typically provides a 3-band EQ prior to sending the signal out of the guitar to be plugged into either an acoustic guitar amp or PA system.

While such a system is inexpensive to implement and minimizes the amplified guitar's tendency to produce feedback at high volumes, the resulting sound is generally considered poor due to the response characteristics of the transducer. In particular, because of the direct coupling of the strings to the piezo element through the saddle, the acoustical effects of the guitar body are all but lost. The sound is generally characterized as thin, brittle and "quacky", and does not compare favorably with the natural sound of a full body acoustic guitar.

Further, guitar players often want to add bass to their sound. One way for a solo performer to do this is to use bass pedals, which greatly complicate the playing. Other methods include devices that will generate bass accompaniment. These can generally be classified into two categories.

The first category are stand-alone octave pedals that accept a mono input from a guitar, and produce a bass (octave shifted) sound from the input. These devices are only musically useful when the performer plays one string at a time. Playing a chord produces an octave double of all the notes and the result is not desirable. They are generally not used with acoustic guitars.

The other category is octave divider algorithms that are integrated into guitar synthesizer systems. These systems can perform per-note octave shifting, but require hex (6-part) pickup systems, specialized connectors and are expensive because of all their other capabilities. Such systems are beyond the budget and requirements of many performers.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

Embodiments of the present invention can restore the character of the natural acoustic sound to the amplified signal coming from a guitar, and to enhance it in other novel ways that make the experience of playing the guitar through an amplification system more enjoyable to both the player as well as to the listener, and can achieve this in a way that doesn't prohibitively impact the methods or cost for manufacturing.

Embodiments of the present invention may include separate features that together produce a more pleasing amplified acoustic sound. One such feature may include enhanced bass using a novel combination of pickup and signal processing. Other features include restoration of the acoustical properties of the guitar body to the resulting sound, and also stereo imaging. Other features may be added, including reverb (mono or stereo) and EQ.

In some embodiments, instead of using a single guitar pickup, two or more smaller pickups are utilized. Each pickup detects signals from only certain strings, and the signals from each pickup may be processed separately. A signal from a pickup for lower pitch strings may be enhanced for bass sounds, including adding in a bass signal as an accompaniment. The different signals may also undergo different processing, and then be combined or provided as stereo output.

In some embodiments, two separate piezo UST (under saddle transducer) pickups are utilized. Both may be located under the saddle of a guitar, one under the bottom (lowest pitch) 2 strings and the other under the top (highest pitch) 4 strings. The respective signals may then be enhanced with a 2-channel preamp (one channel for each transducer) and then digitally processed.

For an embodiment that utilizes bass enhancement, a signal processor receives the pre-amplified signals from the bottom 2 strings (bass) and the top 4 strings (treble) of the guitar separately. The bass signal is then used as input to an octave divider effect. This effect may utilize an algorithm developed specifically for this application, and outputs a version of the input signal that is exactly one octave lower.

An advantage of this embodiment is that a player can, for the most part, simply play the guitar in a normal fashion and the resulting bass that supplements the output will sound musically correct.

For an embodiment that utilizes an acoustical enhancement effect, the output of one or both piezo pickup elements is summed and then processed by a signal processing effect algorithm. This algorithm restores some of the acoustical response of the body of the guitar to the output, and produces a version of the mixed 6-string signal that is more pleasing and natural than the equivalent EQ'd version of the piezo transducer alone.

For an embodiment that utilizes stereo imaging, because the two piezo transducer elements are picking up different strings of the guitar, a stereo image may be created by mixing levels such that, for example, there is more bass on the left and more treble on the right. Also, strumming the guitar produces a slight delay between the onset of the low 2 strings and the upper 4 strings. When this stereo signal is added to the output, a subtle 3-dimensional presence is created which enhances the feeling that the guitar is being played in physical space.

Other processing elements may be utilized by embodiments. These include, but are not limited to, Reverb, Chorus, Delay, Compression and EQ. All of these elements can potentially benefit from having separate input from the bass and treble strings of the guitar.

The end result produces an amplified sound that is unique, more pleasing, and more fun to play, than can otherwise be achieved with a standard UST system, or other type of pickup.

Embodiments include a sound processor for a stringed instrument comprising a transducer component, configured to be positioned proximate to a defined set of one or more adjacent strings of the stringed instrument, wherein the defined set of one or more adjacent strings is less than a total number of strings on the stringed instrument, the transducer component configured to produce a first transducer signal responsive to vibrations from the defined set of one or more strings. It may also include an octave divider component, configured to receive the first transducer signal, the octave divider component configured to produce a bass signal that is at least one octave below a frequency of the first transducer signal. It may also include a combiner component, configured to combine the first transducer signal and the bass signal.

Some embodiments may include where the first transducer signal is digitized, and the octave divider component utilizes a circular buffer wherein values representing the transducer signal are written to the circular buffer at a predetermined rate, and the values are read out of the circular buffer at one-half the predetermined rate. The circular buffer may include two output pointers indicating positions the circular buffer to read out values, and wherein the octave divider component periodically switches between the two output pointers to read values out of the circular buffer. The octave divider component may switch from a first one of the output pointers to a second one of the output pointers, the second output pointer is adjusted to be at a location in the circular buffer that is substantially matches a phase of the transducer signal pointed to by the first output pointer. After the location of the second output pointer is adjusted, the first output point is then adjusted to be at a location in the circular buffer that is half the length of the circular buffer away from the second output pointer.

A sound processor may include a second transducer, configured to be positioned proximate adjacent strings of the stringed instrument that are not part of the defined set of one or more adjacent strings, the second transducer configured to produce a second transducer signal responsive to vibrations from the proximate adjacent strings. The first transducer signal, the second transducer signal, and the bass signal may be combined. In some embodiments, the first transducer signal and the second transducer signal are combined, and the combined signal is digitally processed to produce a sound similar to a sound obtained from an acoustic guitar body. The first transducer and the second transducer may include are under saddle transducer (UST) piezo elements, and the embodiments of the sound processor may be installed in a guitar.

Embodiments may include a method for producing an audio signal, comprising receiving a first audio signal from a transducer positioned on a stringed instrument, the transducer positioned to sense vibrations from a defined set of at least two lower-pitched strings of the stringed instrument, wherein the defined set is less than a total number of strings on the stringed instrument; processing the first audio signal to produce a bass audio signal that is one octave lower than a frequency of the first audio signal; receiving a second audio signal from a second transducer positioned on the stringed instrument to sense vibrations from strings not part of the defined set of lower-pitched strings; and combining the first audio signal, the second audio signal, and the bass audio signal. Processing the first audio signal may include digitizing the first audio signal; inserting values for digitized first audio signal into a circular buffer at a predetermined insertion rate; and producing the bass audio signal by reading the inserted values for the digitized first audio signal from the circular buffer at a rate that is lower than the predetermined insertion rate.

Some embodiments may comprise wherein processing the first audio signal includes digitizing the first audio signal; possibly low pass filtering the digitized audio signal; inserting values for digitized first audio signal into a circular buffer utilizing an input pointer that indicates a position in the circular buffer to insert a subsequent value of the digitized first audio signal input signal, the input pointer advancing at a predetermined insertion rate; utilizing two output pointers positioned a predetermined distance apart from each other, the two output pointers advancing at a rate that is lower than the predetermined insertion rate; selecting one of the two output pointers, and reading the inserted values for the digitized first audio signal from the circular buffer at the selected output pointer; when the input pointer advances to within a predetermined distance of the selected output pointer, adjusting a position of the nonselected output pointer to a location in the circular buffer that substantially matches a phase of the first audio signal as indicated by the selected output pointer; and selecting the unselected output pointer for reading the inserted values from the circular buffer. Adjusting a position of the nonselected output pointer may include determining an offset amount from the selected output pointer back to a prior position containing a first peak signal value stored in the circular buffer; determining a new position for the nonselected output pointer, the new position being from a present position of the nonselected output pointer back to a prior position containing a second peak signal value stored in the circular buffer, plus the offset amount; and moving the nonselected output pointer to the new position, and moving the selected output pointer to a position that is the predetermined distance apart from the nonselected output pointer.

Embodiments may include combining the first audio signal and the second audio signal to produce a combined audio signal; and digitally processing the combined audio signal to produce a sound similar to a sound obtained from an acoustic guitar body. Digitally processing the combined signal may include performing a convolution utilizing coefficients derived from an impulse response from an acoustic guitar. Other embodiments may include combining the first audio signal and the second audio signal to produce a combined audio signal; producing an audio reverb signal from the combined audio signal; and combining the audio reverb signal and the combined audio signal.

Other embodiments may include receiving a digital input signal; storing values for the digital input signal in a circular buffer, wherein an advancing input pointer indicates a position to write a subsequent value of the digital input signal, and two advancing output pointers, the output pointers positioned a predetermined distance apart from each other, and wherein the output pointers advance at a lower rate than the input pointer; selecting one of the output pointers as an active output pointer, and producing an output signal by reading values from the circular buffer at a position of the active output pointer; and when the input pointer advances to within a predetermined distance of one of the output pointers, determining an offset amount from a present position of the active output pointer back to a prior position containing a first peak signal value stored in the circular buffer; determining a new position for the inactive output pointer, the new position being from a present position of the inactive output pointer back to a prior position containing a second peak signal value stored in the circular buffer, plus the offset amount; moving the inactive output pointer to the new position, and moving the active pointer to a position that is the predetermined distance away from the inactive pointer; and switching which output pointer is active. Such embodiments may have use in audio or general signal processing.

An advantage of some embodiments include a system that will produce a rich sound in real time, with little or no discernable time lag or other sound processing artifacts.

Another advantage is a system, apparatus or method that uses simple, inexpensive guitar pickups. The under saddle piezo pickups used by an embodiment of the invention are inexpensive, robust, and invisible from the face of the guitar or stringed instrument. Such under saddle pickups have other advantages, including excellent isolation from acoustic feedback, and also from electronic interference (hum). A guitar or guitar effect according to an embodiment produces a very rich sound at a minimal cost. A low cost guitar may be manufactured or retrofitted and will produce excellent sound.

Still another advantage includes a self contained sound system for a guitar or other instrument. A guitar fitted with an embodiment of the present invention has a standard mono or stereo output jack used by musical instruments, amplifiers and sound systems throughout the world. A guitar player can simply plug his guitar into any sound system using the standard ¼" jack and start playing. There is no special cord or adaptors required.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

The present invention provides a novel system and method for creating superior acoustic sound to the signal coming from a guitar or other instrument. This can be achieved without prohibitively impacting the methods or cost for manufacturing or retrofitting the guitar.

Figure 1:
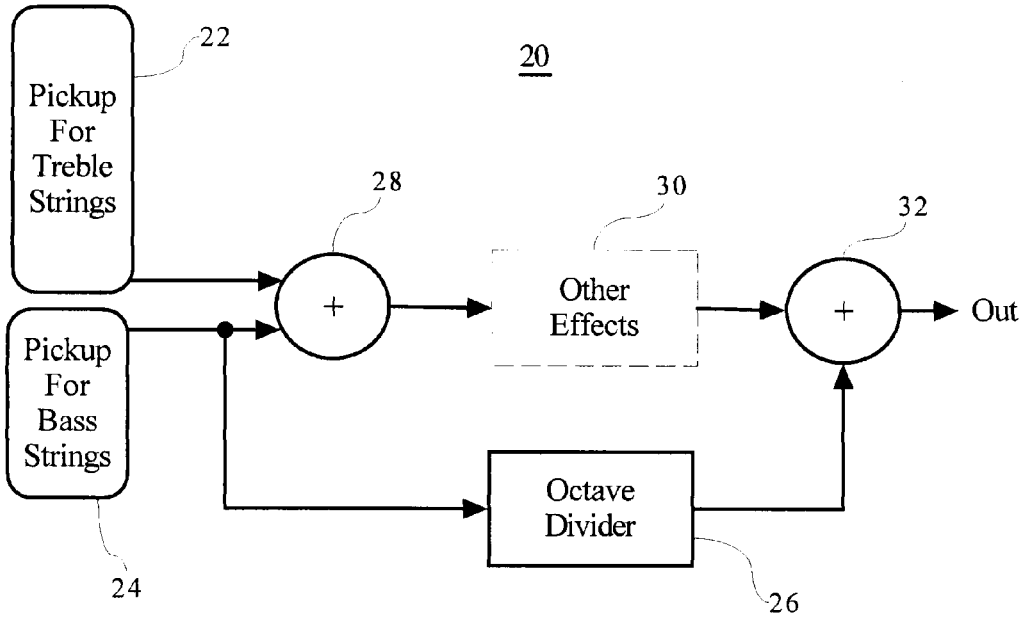
FIG. 1 is a block diagram illustrating stringed instrument sound processing for one or more embodiments of the present invention.

FIG. 1 illustrates an embodiment according to the present invention. A guitar or other stringed instrument pickup is divided into two parts 22 and 24, each of which extends under a subset of the instrument strings. One embodiment utilizes one pickup 24 that extends under the two bass strings (E and A) of a guitar, and a second pickup 22 that extends under the four treble strings (A D B and E) of the guitar. An example of a split pickup that may be used is the Model PP-402 or PP432 4+2 split bridge pickup produced by Artec Corporation of Korea. This is a UST (under saddle transducer) pickup that is installed under the saddle on a guitar. The only modification to this standard part is to separate and lengthen the coax connecting wires to each section. When mounting it in an acoustic guitar, an additional hole may be drilled beneath the guitar saddle to accommodate installation of the second coax wire into the guitar body. The guitar saddle piece may be split into two separate sections at the point between the pickups in order to help acoustically separate the pickups; however this option is not necessary for proper functioning.

Any other type of piezo pickup may also be used, including taking existing under saddle pickups and physically shortening them so they only extend under the desired instrument strings. Other types of transducers or pickups may also be utilized, including magnetic coil pickups and optical pickups.

The signal from the pickup for the bass strings 24 is provided to an octave divider 26, which may produce a signal that tracks the input signal, but at a lower frequency. For a guitar, the octave divider 26 receives a signal input from only the two lowest strings (E and A) of a guitar, and produces a signal that is one octave below. Because one of these two strings is typically sounding the root note of whatever chord is being played on the guitar, this signal is what would result if a bass guitar player accompanied the guitar. An embodiment may take this signal, determine the main frequency of the signal, and synthesize an appropriate bass signal. In one embodiment, the enhanced bass is produced by octave dividing the note or notes produced by the lower frequency strings. This produces a natural sound unlike other systems that synthesize the bass notes. Further, the additional bass provided by an octave divider for this embodiment is automatic, and in real time. More details regarding a pitch shifter or octave divider will be provided below.

The bass output of the octave divider 26 may be combined 32 with other signals from pickups, which may be combined by a combiner 28 and also undergo other processing 30 (as described below) before being combined and then output. The output may be stereo, as will be described below.

In other embodiments, only a pickup 24 under bass strings may be utilized. The signal produced by this pickup 24 may be used to produce the accompanying bass sound. A separate regular pickup extending under all the strings may be utilized for producing a combined output signal for the instrument, which may undergo other processing. Alternatively, the instrument may include no other "regular" pickup, but have instrument sound picked up by a microphone (inside or outside of the instrument). The bass pickup 24 signal may be processed to produce a bass signal added to the PA, or other mixing devices.

Figure 2:
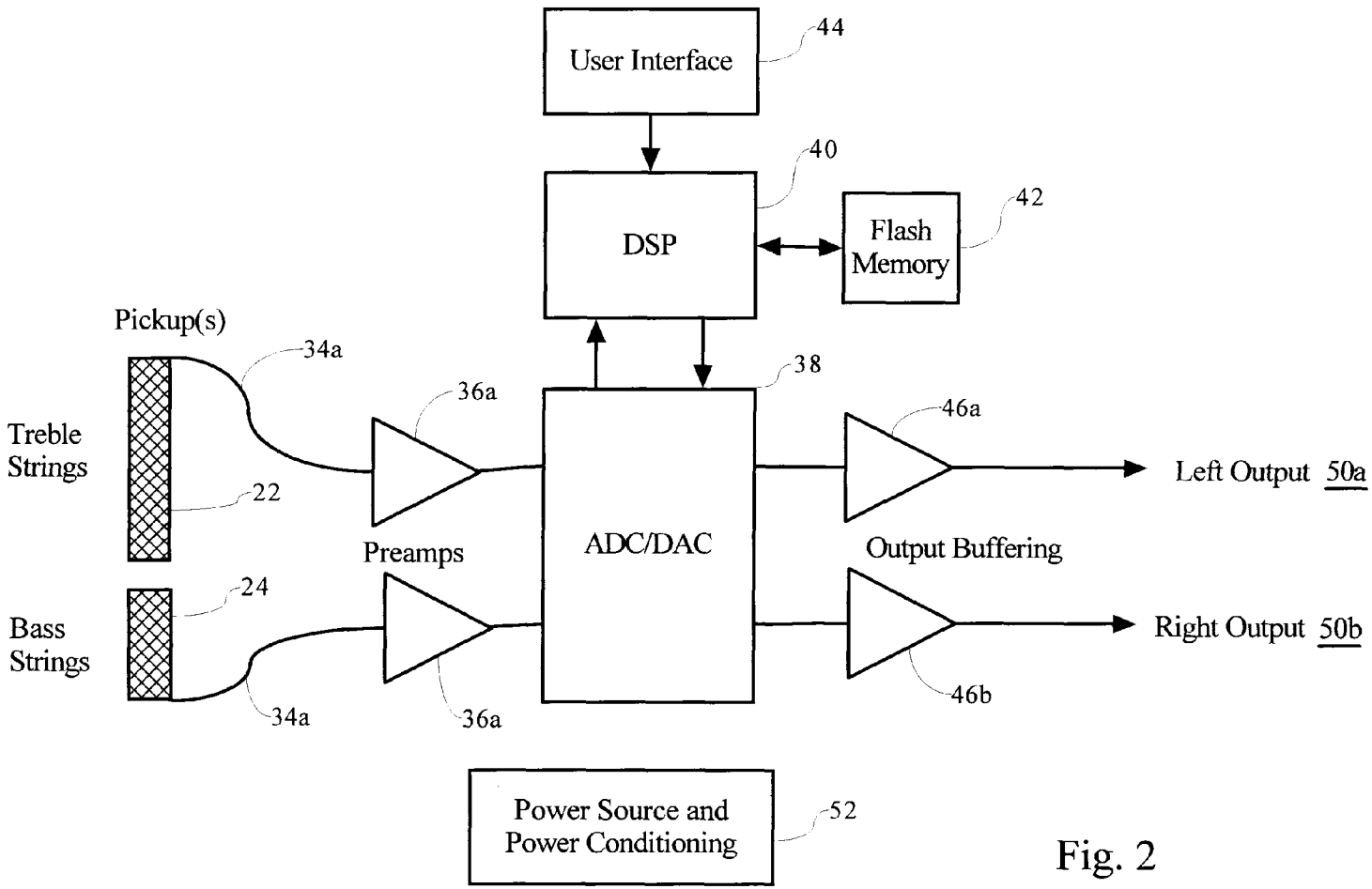
FIG. 2 illustrates a block diagram of components for one or more embodiments of the present invention.

FIG. 2 illustrates components of an embodiment for performing digital signal processing (DSP). Such embodiments may provide real-time processing and output. Signals from the separate pickups 22 and 24 are provided to separate preamp circuits 26. Proper shielding and coax cable may be helpful for all components and connections related to the pickup transducers 22, 24 and preamps 36.

Figure 3:
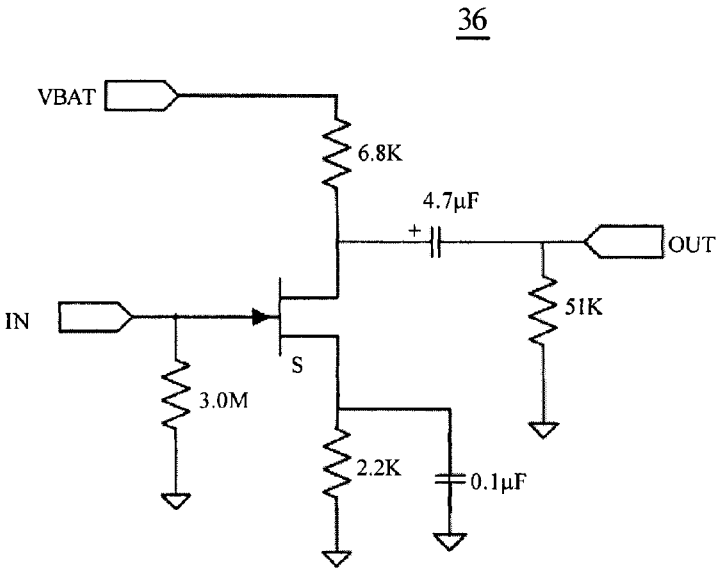
FIG. 3 illustrates a sample pre-amp circuit that may be utilized by one or more embodiments of the present invention.

FIG. 3 shows an example a preamp circuit 36. One preamp circuit is used for each input, and is a simple 2 channel discrete FET design. It may be powered from a 9V battery and has a 3 Meg Ohm input impedance appropriate for a piezo transducer. In one embodiment, a small circuit board fits within a standard preamp enclosure typically found in an acoustic guitar. The circuit board may contain the preamps and connectors necessary to derive power from the battery, receive the 2 inputs from the 2 piezo transducer pickup sections, and route the 2-channel output of the preamp to a stereo endpin jack on the guitar.

Returning to FIG. 2, the signals from the preamps are digitized, and then processed by a digital signal processor (DSP) 40. The signals are digitized using an ADC (analog to digital converter) 38. For this embodiment, an AK4552 device performs the stereo analog-to-digital conversion at 48,000 samples per second with 24-bit precision. Higher or lower sampling rates as well as word lengths may be used by the present invention, depending on processing power, price, desired sound quality etc. The AK4552 performs both analog-to-digital and digital-to-analog conversion, however separate components may handle the conversion, such as an AD1871 ADC for the analog to digital conversion, and an AD1854 stereo DAC (digital to analog converter) for converting back to analog (not shown).

The digitized signals are then provided to the DSP 40. For one embodiment a Blackfin DSP produced by Analog Devices is utilized. Some examples of DSPs are the Blackfin BF537 device, or other devices, such as the less expensive BF531, BF532 or BF533 devices.

The DSP 40 receives two channels of digital audio from the ADC 38 using a serial interface port (SPORT). Channel 1 is the real-time data from the low E and A strings of the guitar, and channel 2 is from the D, G, B and high E strings of the guitar. A second SPORT is used to write two channels of processed digital audio to the digital-to-analog converter. The Digital-to-Analog conversion may be performed, for example, by an AD1854 stereo DAC, or utilizing the AK4552 ADC/DAC 38. The conversion is performed at 48,000 samples per second using 24-bit precision. Alternatively, the digital channels may be directly output, for equipment that can process digital audio. The sample rate and precision of the output channels may be selected as appropriate for the desired output signal.

The ADC/DAC 38 provides the output analog signals to output buffers 46 that provide the correct output impedance and signal level for the intended receiver of the stereo output 50 from the guitar. An example output buffering circuit device is an LMV722V two channel low noise operational amplifier, which provides a 2-channel, single-ended line level output.

A flash memory device 42 contains the operating instructions when the power is shut off, and supporting power conditioning and clock circuitry. In this embodiment the DSP boots and loads operating software from a 4 MBit ST Micro M29W320 DB Flash memory device. The DSP 40 will boot and run the application software upon power-up. Other forms of memory may be used, such as removable memory.

The user interface 44 may provide controls that allow a user to adjust parameters, for example bass, body, reverb, stereo separation, equalization and notch filtering. In one embodiment the user interface may run on a computer and a connection to the DSP 40 and/or memory 42 allows a performer to edit and load presets prior to performing. In another embodiment, the user interface is a small panel on the exposed side of the electronics enclosure in the guitar body. The panel may provide controls for adjusting the levels of the various processing elements, A power source 52 provides power and any necessary power conditioning. A power source may include a 9V battery, or connections to external power source.

In some embodiments, the battery and preamp section are located inside an enclosure in the guitar body, and the remaining components are external, such as in a processing effects box, amplifier, computer, or other devices. In other embodiments, all components are housed within the guitar body, with a standard mono or stereo output cable jack to provide signals to an amplifier.

Figure 4:
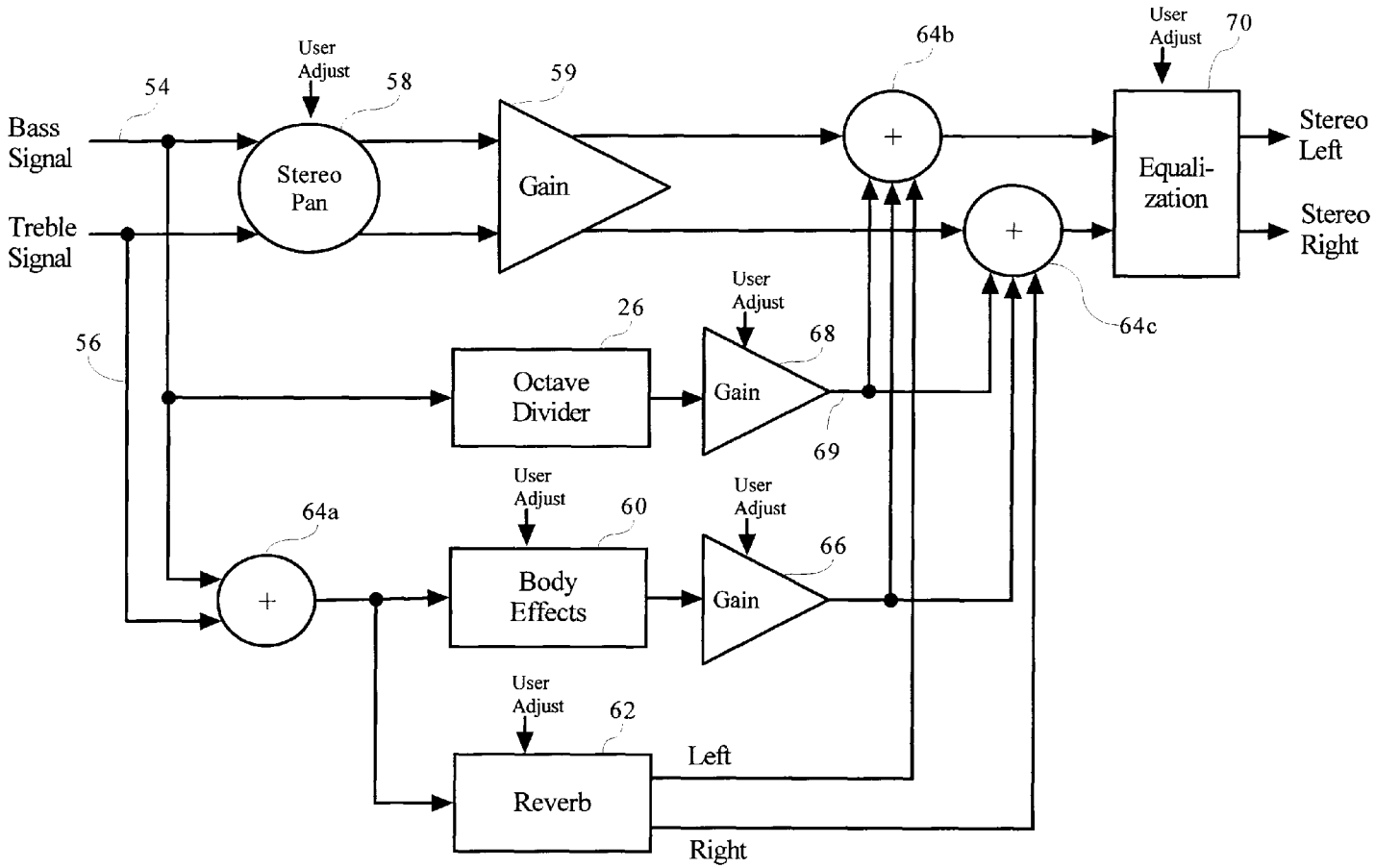
FIG. 4 is a block diagram illustrating a processing system of one or more embodiments.

FIG. 4 illustrates the processing performed by the DSP 40 for an embodiment. This processing is implemented by software running in the DSP. The digital audio input for the bass signal 54 and treble signal 56 is routed to one or more processing elements. These processing elements may include a stereo panner 58, an octave divider 26, and one or more effect chain elements such as an acoustic effects (body) processor 60, and a reverb 62. Other effect elements may be added by implementation in the software. Some processing elements may process only one of the bass signal 54 or treble signal 56, while other processing elements may take both signals, either separately or combined. The output of each the processing elements may be level adjusted and then combined with the other processor element outputs to produce mono or stereo output that becomes the output of the guitar.

A stereo panner element 58 takes both bass signal 54 and treble signal 56. An algorithm for the stereo panner 58 is:

$$\text{Output Channel 1} = g*(\text{Input Channel 1} + (p*\text{Input Channel 2}))$$

$$\text{Output Channel 2} = g*(\text{Input Channel 2} + (p*\text{Input Channel 1}))$$

Where p is used to adjust the stereo separation of the resulting output, and g is the gain to adjust the output level, as adjusted by gain element 59. The stereo panner 58 thus produces a version of the signal coming from the piezo transducers and preamp in which the separation of the separate signals (bass and treble) can be adjusted in both level and in the amount of stereo separation, from completely stereo to completely mono.

Embodiments may include effects chain elements comprising one or more single-channel input processing elements that operate on one signal from the instrument (e.g. all six strings of the guitar). Therefore, for such elements, the bass signal 54 and treble signal 56 are summed (combined) 64*a* to a single channel, thus forming a mono signal for the entire instrument. Two effects chain elements are illustrated in FIG. 4: body effect 60, and reverb 62. These effects as illustrated operate in parallel with the output of each element being gain adjusted 66, before being summed to the final stereo output from the guitar. These effects may alternatively be implemented serially, or with the ability for such chains to be dynamically changed or re-ordered at any time.

Regarding body effect 60, a piezo UST pickup typically picks up only vertical vibrations of the strings on the saddle of the guitar. Also, signals produced piezo UST pickups often are not influenced or "colored" by the acoustically resonant body of a guitar. This resonance is responsible for much of the characteristic warm sound of an acoustic guitar, and in comparison, the raw output of piezo transducers sound thin and brittle. Therefore a body effect 60 element may restore some of this resonance for one or more embodiments. This body effect 60 may be accomplished by convolving the piezo derived input signal with the impulse response of an acoustic guitar body. The impulse response may simply be a recorded sound of an acoustic guitar body excited by an impulse, which is then stored as in-line constants in the program source code for the body effect 60. A convolution is performed using an FIR filter with the coefficients derived from the impulse response. Embodiments may store impulse responses of several different acoustic guitar shapes and sizes, thus providing the user with a choice of selectable "body styles".

The output of the convolution may be multiplied by a user adjustable gain factor 66 to adjust the level before being added equally to both the left and the right channels of the stereo output from the guitar.

Regarding reverb 62, for the embodiment shown in FIG. 4, the reverb effect is a single-channel input, stereo output processor. This allows for stereo reverb that adds warmth and depth to the output. It may be implemented using what is known as a convolution reverb algorithm, as is known in the art. This type of reverb, while computationally more complex than other more common reverb algorithms, is generally considered to produce superior results. Other types of reverb such as models of plate reverb may be utilized, for example to consume less processing power.

As previously mentioned other types of effects chain processes may be added, possibly by downloading additional software to an embodiment.

The octave divider 26 may be a single-channel element, and receives digital audio from only the bass signal 54, which provides a signal for only the low E and A strings of the guitar. The octave divider 26 will output a version of the input signal that is pitch shifted exactly one octave below that of the input.

In order to keep latency to a minimum, the octave divider 26 effect for this embodiment works without having to explicitly detect the frequency of the input signal. It does this by utilizing the fact that a one-octave downward pitch shift can be accomplished by halving the output sample rate. This produces an output that is one octave below the input. However, if one simply outputs digital audio at one half the input sample rate, the output will quickly fall behind the input. Therefore, the octave divider 26 effect for this embodiment will output sections of the input data at half the sample rate, and then splice these sections together in order to keep up in time with the input. In effect, the output skips over sections of the input in order to keep up.

The octave divider 26 for one or more embodiment works by placing digital audio samples into a circular buffer using in input pointer. Digital audio is then read out from this buffer using two output pointers incremented at one half the incoming sample rate. The output pointers are spaced one half buffer length apart, and the embodiment alternately switches between these two pointers.

Like most elements and effects, the octave divider 26 element, processes blocks of audio data at a time, however the following description provides details by considering that the process really works on a sample-by-sample basis. The following description assumes that the octave divider 26 element runs a single iteration for each successive audio sample for the bass signal 54.

FIG. 5 illustrates processing by an embodiment of the octave divider 26. The octave divider is implemented using a 4096 sample circular memory buffer 72 into which the input is placed (at 48,000 samples per second) using an Input Pointer (IP) as an index. This IP is incremented for each sample and wraps back to the start of the buffer when the end of the buffer 72 is reached. The output audio data is taken from the buffer using one of two output pointers (OP1 and OP2). These output pointers are always indexing buffer locations exactly ½ buffer, or 2048 samples from one another. The IP, OP1 and OP2 all increment (move) around the buffer 72 in the same direction, as shown by arrow 74, and wrap back to the start of the buffer when the end of the buffer is reached. However both output pointers increment every other sample.

Since the output pointers are cycling through the buffer half as fast as the IP, the IP will alternately "collide" with each output pointer once per cycle through the buffer 72. The embodiment compensates for this by using OP1 for one cycle and OP2 for the other cycle.

Figures 5A, 5B, 5C:
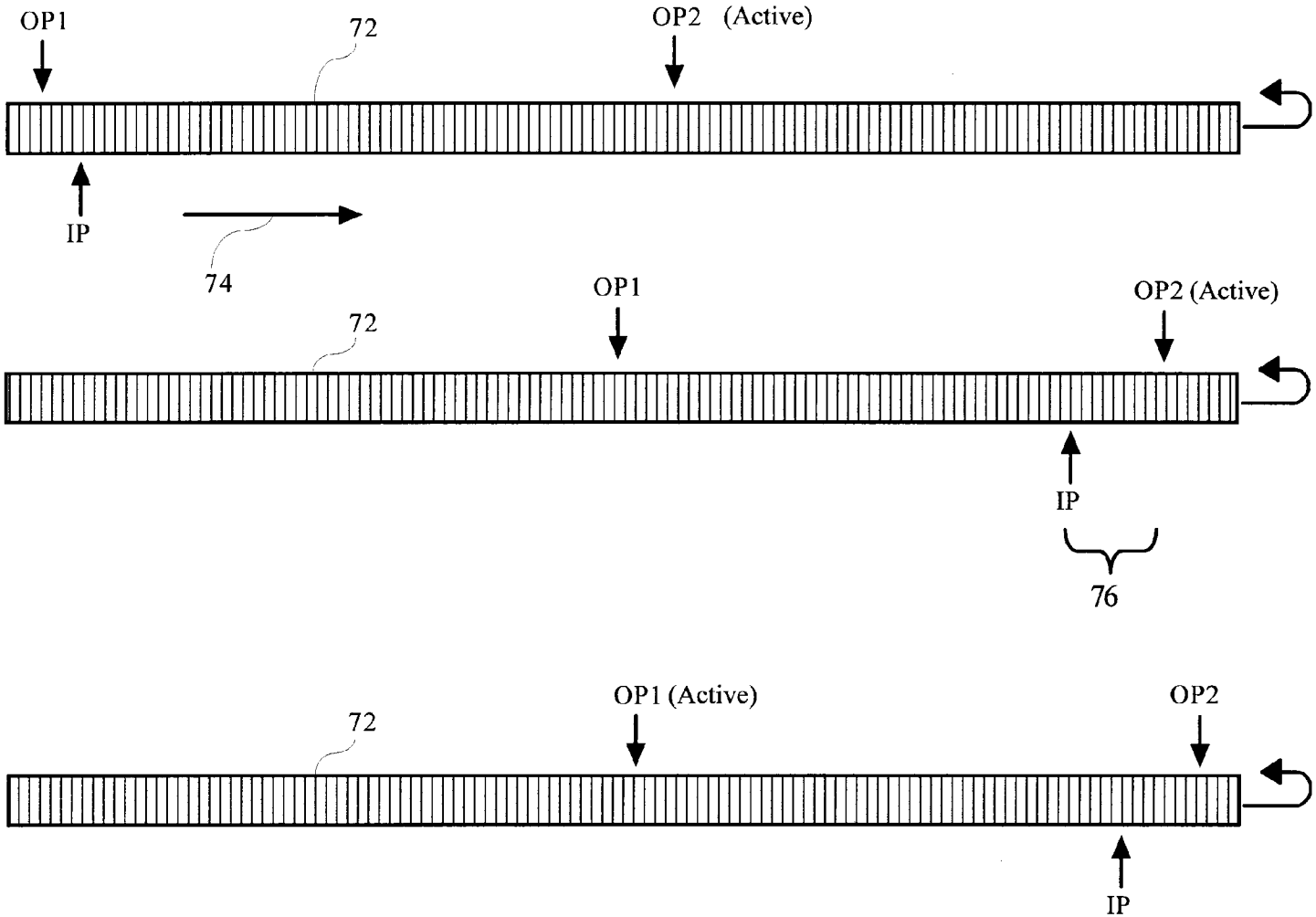
FIG. 5 illustrates the processing by an octave divider according to some embodiments.

FIGS. 5*a*-5*c* illustrates sequential examples of the pointer positions. In FIG. 5*a*, the IP has just caught up to and passed OP1, and the embodiment is currently reading output from sample pointed to (indexed) by OP2 (therefore OP2 is indicated as "active"). The active output pointer should be switched before the IP catches up to it. The embodiment switches output pointers when the IP is within a predetermined distance 76 of colliding with, or catching up to, the output pointer currently being used. In FIG. 5*b*, the IP has come within a predetermined distance 76 of active pointer OP2, and it is therefore time to switch to OP1. The predetermined distance 76 for this embodiment is ⅛ the size of the total buffer (in the case of a 4096 sample buffer, the distance 76 would be 512 samples. However, other distances or criteria may also be utilized. A size may be selected to provide time for a proper switching before the IP catches up to the active OP, balanced against having switching operations occur too frequently. In FIG. 5*c*, OP1 is now the active pointer, and the IP is about to pass OP2. When the IP gets within the predetermined distance to OP1, then OP2 will then become the active pointer again.

As previously described the output signal produced from reading the values from the active output pointer will be a version of the input signal exactly one octave lower in pitch. Other read-out rates from the output pointers may be utilized to produced output signals at other pitches, such as reading output pointers at ¼ the rate of the input pointer which will result in an output signal two octaves lower. One advantage of such an octave divider is that the output accurately tracks the pitch of the input. If an instrument has alternative turnings, or is played using a slide or string bending, the octave divider still correctly tracks the signal.

At the point of switching output pointers, there may be discontinuities in the output signal. Such discontinuities may affect both the output signal level and phase at the switch times. This is because the input signal waveform has no relationship to the buffer length and the splice points will be arbitrary with respect to the input waveform.

Previous implementations of octave dividers address these discontinuities by cross fading the audio over some number of samples. However, because this method does not take into account the phase of the fundamental waveform, the resulting phase shift at the splice points leads to undesirable artifacts in the output audio. Further, this method was tested and found to work poorly, especially with the low strings of a guitar. A vibrating string has a strong fundamental approximating a sine wave. While cross fading removes the discontinuities in the resulting output waveform, each section is likely to not be in phase with the previous section, since the wavelength of the notes fundamental is not related to the length of the buffer. The resulting phase shift in each section may cause an unpleasant "rumbling" sound and distorts the perceived pitch of the resulting bass sound. This might be alleviated by tuning the buffer length to a particular wavelength, but it would only work for that one note.

Instead, an embodiment examines the audio data at each output pointer in order to locate key points in the waveform of the fundamental frequency, and then uses this information to adjust the output pointers so that the waveform sections are substantially lined up according to the wavelength of the fundamental frequency being played. This thereby minimizes discontinuities by preserving the phase of the signal over the splice points.

In more general terms, the embodiment dynamically adjusts the lengths of the output sections according the pitch of the note being played at any moment.

The embodiment continuously analyzes the waveform at both output pointers in order to determine splice points, and when the output pointers are switched, the new active output pointer is adjusted backwards so that it points to a spot in the waveform cycle which is similar to that pointed to by the old output pointer. Finally, the old output pointer is adjusted backwards so that it is exactly ½ the buffer from the new output pointer.

Figure 6:
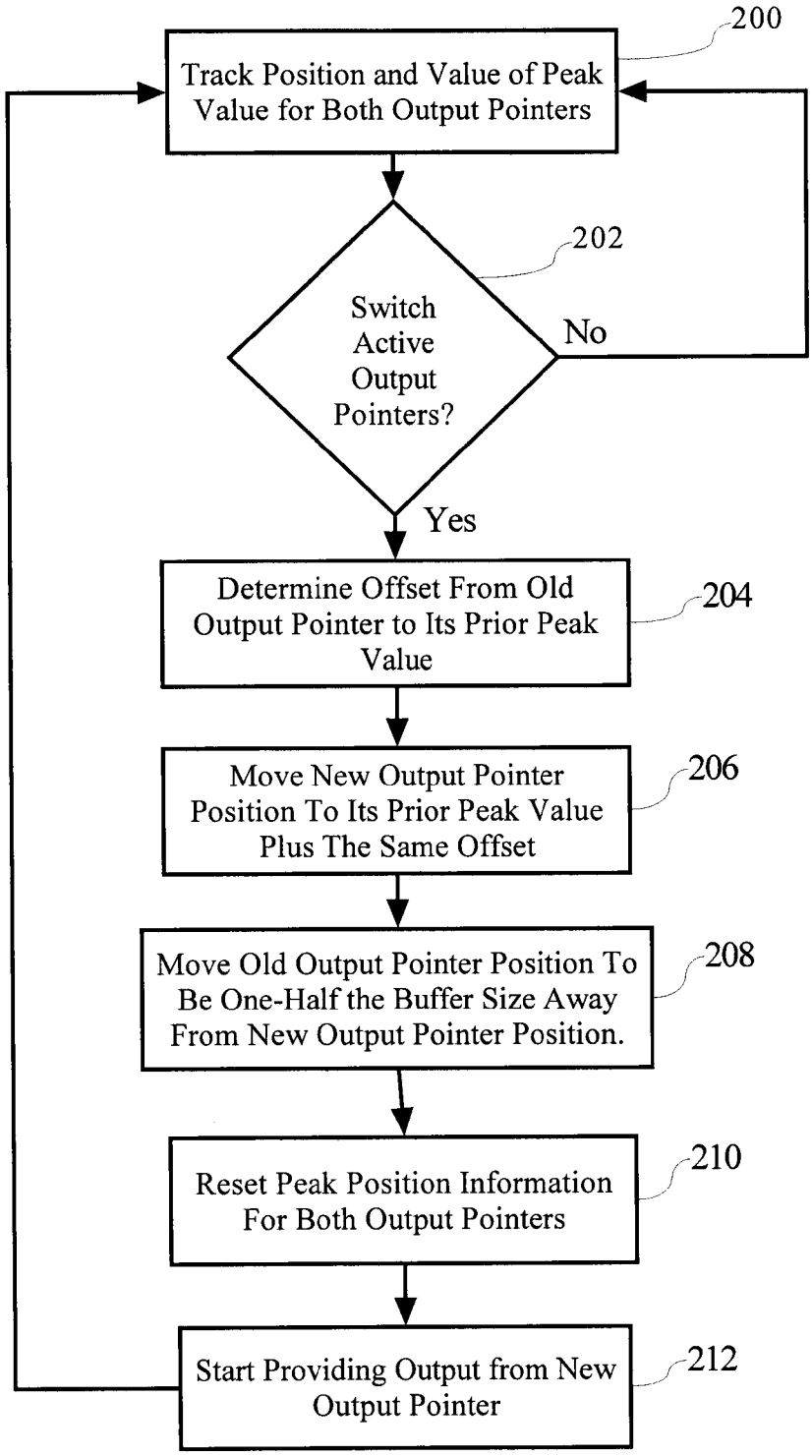
FIG. 6 is a flow chart illustrating a process performed by one or more embodiments.

FIG. 6 illustrates this process. The waveform analysis is performed by looking for positive peaks in the waveform, step 200. This may be made simpler by applying a low pass filter to the input of the octave divider before placing the audio data into the buffer. The embodiment implements an IIR (infinite impulse response) low pass pre-filter with a cutoff frequency of 125 Hz and a Q of 2.0. These parameters were chosen after an examination of the waveforms produced by the low E and A strings on a guitar up through the 14th fret. The goal is to filter out all but the fundamental and first harmonic frequencies within that range in order to make the peak detection easier to accomplish.

Each output pointer has the following structure definition:

```
typedef struct
    {
    int iPtr;                    // Output pointer
    Q1_31 qPkVal;                // Last valid peak value
    int iPkPtr;                  // Last valid peak pointer
    Q1_31 qPkTmpVal;             // Temp peak value
    int iPkTmpPtr;               // Temp peak pointer
    Q1_31 qPkNewVal;             // New peak candidate value
    int iPkNewPtr;               // New peak candidate pointer
    bool bPkLatch;               // Peak latch flag
    int iPosCount;               // Positive phase sample count
    int iNegCount;               // Negative phase sample count
    } OUT_STRUCTURE;
```

This data structure is updated each time the corresponding output pointer is incremented, and both OP1 and OP2 are incremented every other input sample, even though only one is being used for the output.

The filtered data at each output pointer is examined to determine if it is more positive than the currently stored maximum. If so, both the value and a pointer to this sample are saved. When the positive portion of the waveform is completed, being determined when a minimum number of negative values are encountered, the highest value found is considered to be the peak in the waveform.

The Boolean pPkLatch (Peak Latch Flag) is used to indicate that we have completed a positive phase of the cycle and latched a new peak value and pointer. It is set when we encounter more than a minimum number (4) of consecutive negative samples and are thus considered to be in the negative phase of the waveform cycle. It is cleared when we encounter a minimum number (4) of positive samples and we thus assume that we have just entered a new positive phase of the waveform cycle.

Each time an output pointer is incremented the following analysis takes place:

If the value of the digital audio at the output pointer is positive, and the Peak Latch Flag is false, then if the value is higher than the previously saved new peak, qPkNewVal, we overwrite qPkNewVal with the new value and save the current output pointer in iPkNewPtr.

If the value of the digital audio at the output pointer is positive, but the Peak Latch Flag is true, and there have been at least a minimum (4) sample of consecutive positive values, then we have just entered the positive phase of the waveform cycle. We clear the Peak Latch Flag and set qPkNewVal equal to 0.

If the value of the digital audio at the output pointer is negative, and the Peak Latch Flag is true, we do nothing.

If the value of the digital audio at the output pointer is negative, but the Peak Latch Flag is false, and there have been at least a minimum (4) sample of consecutive negative values, then we have just entered the negative phase of the waveform cycle. We set the Peak Latch Flag and perform the following analysis:

We first compare the stored peak value qPkNewVal with a value calculated as (r*average signal level). The average signal level is a running average of the absolute value of the input audio. If the value at qPkNewVal is less than this amount, we ignore it—it is probably low-level noise. (It can't be a peak if it's not at least as high as the average signal level.)

If qPkTmpVal (which will be described below) is non-zero, then the larger of the two values, qPkTmpVal or qPkNewVal, is now transferred the final latched peak value qPkVal, and iPkPtr is set to the corresponding pointer of the larger value. We set qPkTmpVal to 0 and consider that we have now found the peak.

If qPkTmpVal is 0, then we compare qPkNewVal to the peak level from the last positive cycle. If it is within a certain percentage of the last peak value, then we consider it a new peak and transfer both the value and its pointer to qPkVal and iPkPtr respectively. If it is lower than this amount, then we save the value and pointer as qPkTmpVal and iPkTmpPtr. This logic derives from the fact that the waveform is generally slow changing when strings are left ringing. That is, unless a new event occurs, each fundamental peak will be close in level to the previous peak—we would not expect a sudden drop in peak level unless the note was either changed or muted.

It was found that qPkTmpVal and iPkTmpPtr are helpful to address the problem of the first harmonic. After the bass string audio has been LP filtered, it contains only the fundamental and the first harmonic. Often, and especially when an open string (non-fretted) note is struck, the first harmonic level becomes a significant component of the waveform over time. Sometimes the first harmonic causes an additional two zero crossings within a single cycle of the fundamental, The first harmonic may cause a complete positive going phase with a corresponding peak, however this peak will not be as high as that of the fundamental. The addition of the qPkTmpVal variable serves to distinguish the smaller peak of the first harmonic from the larger peak of the fundamental, and this embodiment will correctly locate the higher positive peaks as the real peaks of the fundamental frequency.

At some point it will be necessary to switch output pointers, step 202 FIG. 6. As previous described, the octave divider switches output pointers based on the position of the IP with respect to the output pointer currently being used (the "active" output pointer). Each time the IP is incremented, the algorithm calculates how many samples the IP trails the currently active output pointer. When this distance is predetermined distance (for this embodiment, ⅛ of the buffer length), an output pointer switch is requested.

In an embodiment, the algorithm also detects when the IP collides with the output pointer that is not currently active. (Note that the IP collides with the inactive output pointer and not with the active output pointer). This is because the inactive output pointer will see discontinuous data at that point (because the IP will writes over the previous data as it passes by) and therefore all of the variables related to peak detection should be reset.

The pointer-switching process determines how many samples the old (active) output pointer is from the last peak, step 204. First we compare the qPkNewVal and qPkVal variables of the old output pointer and take the larger of the two values as the peak. This is necessary because we may be switching before the end of the current positive phase of the waveform. Then we calculate the number of samples between the current active output pointer and the pointer to the peak value and save as an offset.

This offset is then added the peak position for the new OP, step 206. We compare qPkNewVal and qPkVal for the new output pointer and take the larger of the two values as the last peak for that pointer. Then we add the offset to that peak pointer and set the new output pointer to this value.

The old output pointer is now adjusted backwards to be exactly ½ buffer away from the new OP, step 208. Finally, all the variables for both output pointers are reset, step 210. The new active output pointer is now used to read output values, step 212.

Figure 7:
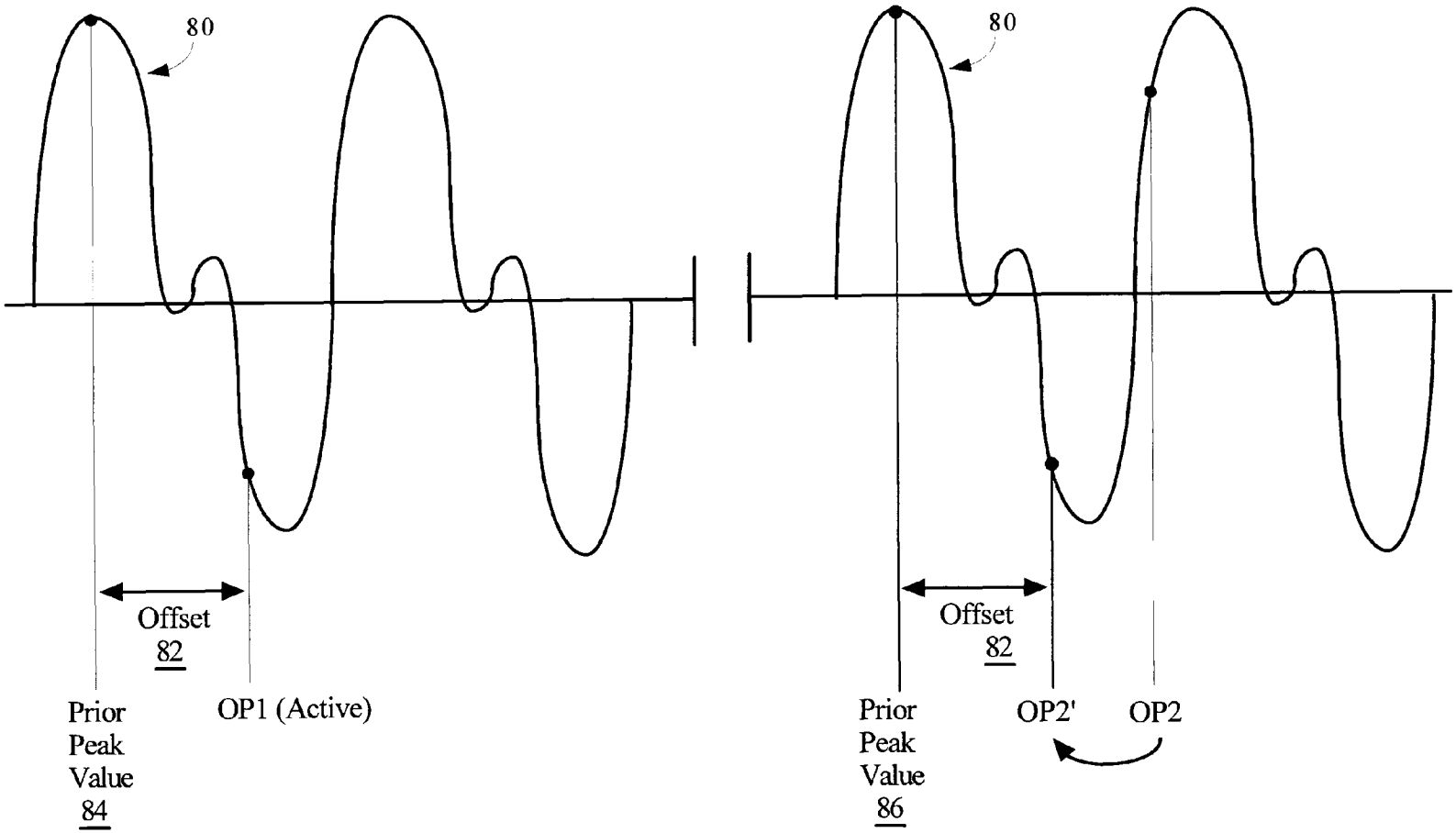
FIG. 7 illustrates analysis of a waveform signal according to some embodiments.

FIG. 7 helps illustrates this process. Two sections of an audio waveform 80 are shown, each section showing a part of the wave where the output pointers OP1 and OP2 are "tracking" (i.e. pointing to buffer positions containing a digital representation of that sample of the waveform). For this example, we are switching from OP1 to OP2. The offset 82 is calculated as the distance from OP1 to the previous peak 84. That offset is then added to the previous peak 86 from OP2; and OP2 is adjusted backwards to this point (Indicated as OP2'). Therefore OP2 will begin playing at a similar same phase in the waveform 80 as OP1 was. Any discontinuities, phase changes, or other artifacts in the output signal are minimized. Finally, OP1 will be adjusted to be at pointing at a location ½ the buffer distance from the new position of OP2 (not shown in FIG. 7).

For guitar signals, the waveform tends to change slowly, so that it is possible to locate similar points in the waveform that are separated by ½ of the buffer. Because of the frequencies involved and the relatively simple nature of a waveform of a vibrating guitar string, this algorithm works very well. An embodiment may process the output with an IIR low pass post-filter with a cutoff frequency of 200 Hz and a Q of 1.0, to minimize any small discontinuities at the switch points, caused by the waveform changing over time.

Returning to FIG. 4, output of the octave divider 26 may then be multiplied by an adjustable gain factor 68 that determines the overall volume of the resulting bass signal. This bass signal 69 may then added equally to both the left and right stereo outputs 64*b* and 64*c* for the guitar signal. The signals from all the different processing effects may be summed up 64*b* and 64*c* in the channels, and a final user adjustable equalization stage 70 may be performed. The signals are then outputted, typically with conversion back into analog signals, as previously described.

One embodiment may take output audio data for the octave divider element directly from the buffer 72 used for the peak detection analysis. As previously described, the audio signal for this buffer may be low pass (LP) filtered in order to remove all but the fundamental and first harmonic for the benefit of the peak detection algorithm. Therefore, the resulting bass signal 69 will contain no upper harmonic information present in the original input; therefore this bass signal may have less higher frequency snap and brightness. However, since this bass signal is then combined with the original string sound, any effect this may have is alleviated.

An embodiment may include a second audio buffer into which unfiltered samples are placed. The peak detection process would continue to use the LP filtered buffer as described above, but the output data will come from the unfiltered buffer. The output from the unfiltered buffer may be passed through the LP post filter with a cutoff frequency selected to minimize any discontinuities but allow many of the harmonics to pass.

Although embodiments of the present invention are described utilizing separate pickups, other embodiments may utilize one instrument signal and perform filtering and/or DSP to determine a fundamental signal with which to produce a bass signal with an octave divider. In this case, a guitar or other instrument may require no changes, and effects according to such embodiments may be external devices (battery-powered or line powered) into which any existing guitar can be plugged.

Although described in terms of an acoustic guitar, embodiments of the present invention are usable by any type of multi-stringed instrument. For example, the present invention can be used for, but not limited to, electric guitars, 12-string guitars, basses, steel guitars, violins, mandolins, banjos, fiddles, pianos, harpsichords, and any other type of stringed instrument whether plucked or bowed. Any type of strings, whether metal, nylon, catgut, etc. will work. Embodiments may be incorporated into guitars and other instruments as they are built. Alternatively, embodiments may be added to existing guitars and instruments with minimal cost, effort, and invasive changes. For guitars with existing built-in piezo transducers and preamp circuit, an embodiment with signal processing abilities as described will fit within the same compartment as the original preamp and EQ circuit, and can be powered from the same 9-volt battery. The hardware cost of adding an embodiment to a guitar may simply be the incremental cost of the 2-piece piezo transducer and the addition of the DSP and support circuitry.

Other embodiments may include a simulation for a 12-string guitar. A 12-string guitar typically has two strings tuned an octave apart for each of the four lower pitch strings, and two strings tuned to the same note for the two higher pitched strings. An embodiment may utilize a six-string guitar and place certain pickups under different sets of strings. For example, a first pickup may be positioned to pick up signals from the lowest four strings on a guitar (E A D G) and a second pickup positioned for the two highest strings on the guitar (B and high E). The signal from the four lower strings may be combined with an pitch shifted signal to produce a sound similar to double strings an octave apart, while the signal from the two higher strings may be processed by a double effect or chorus effect to produce a sound as if from double strings of the same pitch.

Further, the present invention may be implemented in different configurations, such as having various portions of the system located in different components. An example is a guitar or other instrument that only contains a split pickup, and possibly a pre-amp. The signals from the pickup is then sent out through one or more instrument cords (or instrument wireless transmitters) to a processing unit located in an amplifier, stomp box, effects box, or computer system. The present invention may also be implemented as an effect for use with sound editing and production systems, such as digital audio workstations. The present invention may be a stand-alone application, or as a plug-in.

One or more aspects of the invention may be embodied in computer-usable data and computer-executable instructions, such as in one or more program modules, executed by one or more computers or other devices. Generally, program modules include routines, programs, objects, components, data structures, etc. that perform particular tasks or implement particular abstract data types when executed by a processor in a computer or other device. The computer executable instructions may be stored on a computer readable medium such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the invention, and such data structures are contemplated within the scope of computer executable instructions and computer-usable data described herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A sound processor for a stringed instrument comprising:

a transducer component, configured to be positioned proximate to a defined set of one or more adjacent strings of the stringed instrument, wherein the defined set of one or more adjacent strings is less than a total number of strings on the stringed instrument, the transducer component configured to produce a first transducer signal responsive to vibrations from the defined set of one or more strings and an octave divider component, configured to receive the first transducer signal, the octave divider component configured to produce a bass signal that is at least one octave below a frequency of the first transducer signal; the octave divider component utilizing a circular buffer wherein values representing the first transducer signal are written to the circular buffer at a predetermined rate, and the values are read out of the circular buffer at one-half the predetermined rate;

wherein the circular buffer includes two output pointers indicating positions in the circular buffer to read out values, and wherein the octave divider component periodically switches between the two output pointers to read values out of the circular buffer.

2. The sound processor of claim 1, further including a combiner component, configured to combine the first transducer signal and the bass signal.

3. The sound processor of claim 1, wherein when the octave divider component switches from a first one of the output pointers to a second one of the output pointers, and the second output pointer is adjusted to be at a location in the circular buffer that substantially matches a phase of the transducer signal pointed to by the first output pointer.

4. The sound processor of claim 3, wherein after the location of the second output pointer is adjusted, the first output point is then adjusted to be at a location in the circular buffer that is half the length of the circular buffer away from the second output pointer.

5. The sound processor of claim 1, further including:

a second transducer, configured to be positioned proximate adjacent strings of the stringed instrument that are not part of the defined set of one or more adjacent strings, the second transducer configured to produce a second transducer signal responsive to vibrations from the proximate adjacent strings.

6. The sound processor of claim 5, wherein the first transducer signal, the second transducer signal, and the bass signal are combined.

7. The sound processor of claim 5, wherein the first transducer signal and the second transducer signal are combined, and the combined signal is digitally processed by performing a convolution utilizing coefficients derived from an impulse response from an acoustic guitar.

8. The sound processor of claim 5 wherein the first transducer and the second transducer are under saddle transducer (UST) piezo elements.

9. The sound processor of claim 1 wherein the sound processor is installed in a guitar.

10. A method for producing an audio signal, comprising:

receiving a first audio signal from a transducer positioned on a stringed instrument, the transducer positioned to sense vibrations from a defined set of at least two lower-pitched strings of the stringed instrument, wherein the defined set is less than a total number of strings on the stringed instrument;

digitizing the first audio signal;

inserting values for digitized first audio signal into a circular buffer utilizing an input pointer that indicates a position in the circular buffer to insert a subsequent value of the digitized first audio signal input signal, the input pointer advancing at a predetermined insertion rate;

utilizing two output pointers positioned a predetermined distance apart from each other, the two output pointers advancing at a rate that is lower than the predetermined insertion rate;

selecting one of the two output pointers, and reading the inserted values for the digitized first audio signal from the circular buffer at the selected output pointer to produce a bass audio signal;

when the input pointer advances to within a predetermined distance of the selected output pointer, adjusting a position of the nonselected output pointer to a location in the circular buffer that substantially matches a phase of the first audio signal as indicated by the selected output pointer; and selecting the unselected output pointer for reading the inserted values from the circular buffer.

11. The method of claim 10, wherein adjusting a position of the nonselected output pointer includes:

determining an offset amount from the selected output pointer back to a prior position containing a first peak signal value stored in the circular buffer;

determining a new position for the nonselected output pointer, the new position being from a present position of the nonselected output pointer back to a prior position containing a second peak signal value stored in the circular buffer, plus the offset amount; and moving the nonselected output pointer to the new position, and moving the selected output pointer to a position that is the predetermined distance apart from the nonselected output pointer.

12. The method of claim 10 further including:

after digitizing the first audio signal, low pass filtering the digitized first audio signal.

13. The method of claim 12 wherein digitally processing the combined signal includes performing a convolution utilizing coefficients derived from an impulse response from an acoustic guitar.

14. The method of claim 10 including:

combining the first audio signal and the second audio signal to produce a combined audio signal;

producing an audio reverb signal from the combined audio signal; and combining the audio reverb signal and the combined audio signal.

15. The method of claim 10 further including:

receiving a second audio signal from a second transducer positioned on the stringed instrument to sense vibrations from strings not part of the defined set of lower-pitched strings; and combining the first audio signal, the second audio signal, and the bass audio signal.

16. A guitar, comprising:

a transducer component, configured to be positioned proximate to a defined set of one or more adjacent strings of the guitar, wherein the defined set of one or more adjacent strings is less than a total number of strings on the guitar, the transducer component configured to produce a first transducer signal responsive to vibrations from the defined set of one or more strings and an octave divider component, configured to receive the first transducer signal, the octave divider component configured to produce a bass signal that is at least one octave below a frequency of the first transducer signal; the octave divider component utilizing a circular buffer wherein values representing the first transducer signal are written to the circular buffer at a predetermined rate, and the values are read out of the circular buffer at one-half the predetermined rate to produce the bass signal;

wherein the circular buffer includes two output pointers indicating positions in the circular buffer to read out values, and wherein the octave divider component periodically switches between the two output pointers to read values out of the circular buffer.

17. The guitar of claim 16, wherein when the octave divider component switches from a first one of the output pointers to a second one of the output pointers, and the second output pointer is adjusted to be at a location in the circular buffer that substantially matches a phase of the transducer signal pointed to by the first output pointer.

18. The guitar of claim 17, wherein after the location of the second output pointer is adjusted, the first output point is then adjusted to be at a location in the circular buffer that is half the length of the circular buffer away from the second output pointer.

* * * * *